US009091224B2

(12) United States Patent
Stevens

(10) Patent No.: US 9,091,224 B2
(45) Date of Patent: Jul. 28, 2015

(54) ENGINE CONTROL UNIT USING SPEED DENSITY CONVERSION

(75) Inventor: Derek Stevens, Redondo Beach, CA (US)

(73) Assignee: HONDATA, INC., Torrance, CA (US)

( * ) Notice: Subject to any disclaimer, the term of this patent is extended or adjusted under 35 U.S.C. 154(b) by 373 days.

(21) Appl. No.: 13/489,134

(22) Filed: Jun. 5, 2012

(65) Prior Publication Data

US 2013/0319377 A1 Dec. 5, 2013

(51) Int. Cl.
*F02D 41/40* (2006.01)
*F02D 41/04* (2006.01)
*F02D 41/18* (2006.01)

(52) U.S. Cl.
CPC ..... *F02D 41/04* (2013.01); *F02D 41/182* (2013.01); *F02D 41/40* (2013.01); *F02D 2200/0406* (2013.01); *F02D 2200/0414* (2013.01); *F02D 2200/101* (2013.01); *F02D 2400/08* (2013.01)

(58) Field of Classification Search
CPC ..... F02D 41/40; F02D 2400/08
USPC ..... 701/104, 105; 123/678, 689
See application file for complete search history.

(56) References Cited

U.S. PATENT DOCUMENTS

| | | | | | |
|---|---|---|---|---|---|
| 5,068,794 | A * | 11/1991 | Hosaka | ..... | 701/104 |
| 5,384,707 | A * | 1/1995 | Kerns et al. | ..... | 701/114 |
| 6,161,530 | A * | 12/2000 | Kakizaki et al. | ..... | 123/674 |
| 6,687,597 | B2 * | 2/2004 | Sulatisky et al. | ..... | 701/104 |
| 7,082,925 | B2 * | 8/2006 | Katrak et al. | ..... | 123/396 |
| 7,273,046 | B2 * | 9/2007 | Osumi | ..... | 123/681 |
| 7,313,474 | B2 * | 12/2007 | Bowling et al. | ..... | 701/102 |
| 7,321,820 | B2 * | 1/2008 | Yanakiev et al. | ..... | 701/105 |
| 7,774,130 | B2 * | 8/2010 | Pepper | ..... | 701/123 |
| 8,364,373 | B2 * | 1/2013 | Whitney et al. | ..... | 701/85 |
| 2002/0133286 | A1 * | 9/2002 | Kolmanovsky et al. | ..... | 701/104 |
| 2005/0274357 | A1 * | 12/2005 | Matthews et al. | ..... | 123/350 |
| 2007/0088487 | A1 * | 4/2007 | Lahti et al. | ..... | 701/104 |

* cited by examiner

*Primary Examiner* — Erick Solis
(74) *Attorney, Agent, or Firm* — Fulwider Patton LLP

(57) ABSTRACT

The present invention utilizes a speed density method for determining the cylinder air mass using volumetric efficiency (VE) based on engine speed and manifold pressure. The VE data contain the cylinder filling efficiency for various engine speed and manifold pressure values. The manifold pressure is then measured by a manifold absolution pressure (MAP) sensor. Using the speed density has the advantage that it is much less affected by pulsation in the intake system of the vehicle, and does not require a linear air flow past a sensor in the engine intake system.

3 Claims, 7 Drawing Sheets

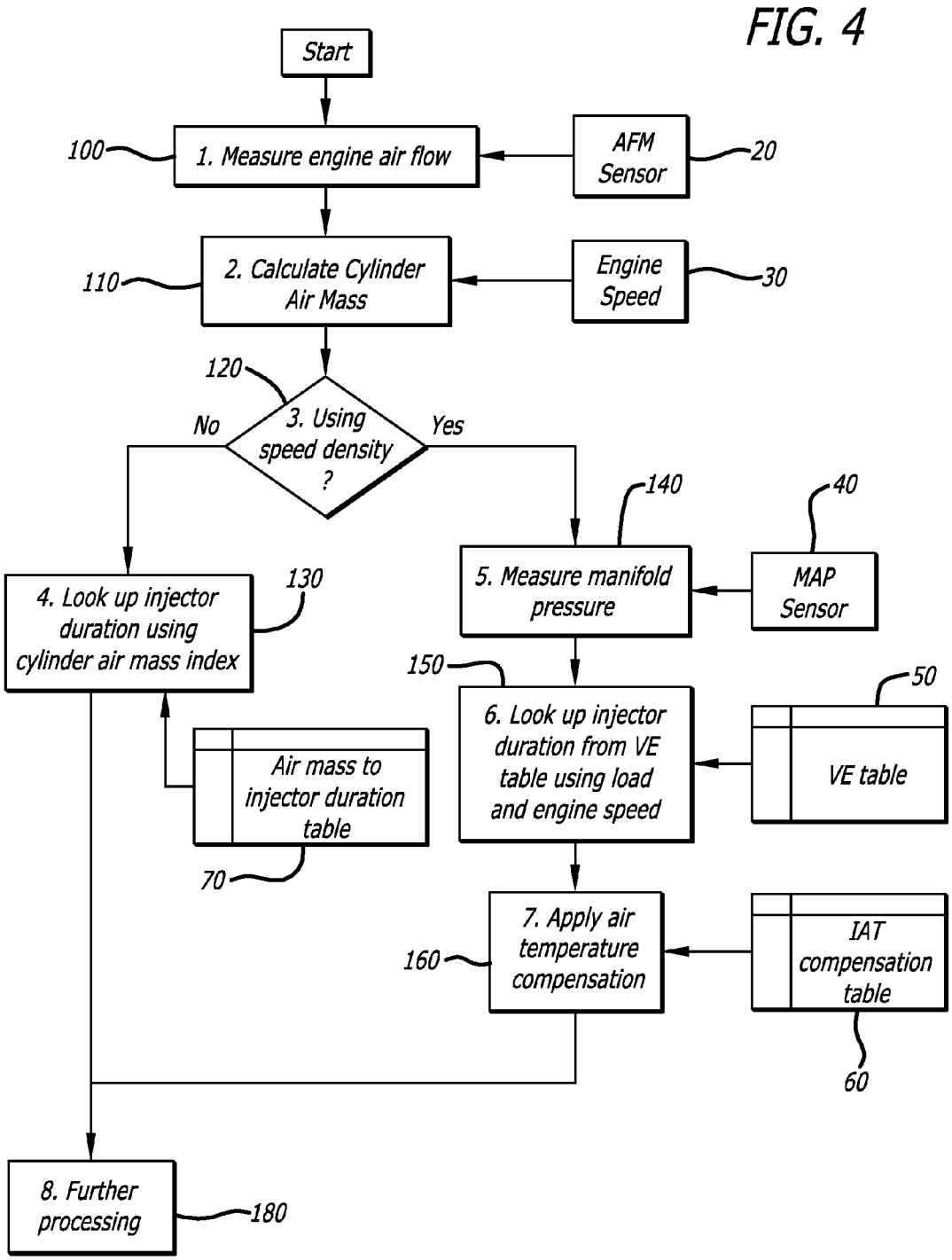
FIG. 4
Start
1. Measure engine air flow
100
AFM Sensor
20
2. Calculate Cylinder Air Mass
110
Engine Speed
30
120
3. Using speed density ?
No
Yes
140
40
4. Look up injector duration using cylinder air mass index
130
5. Measure manifold pressure
MAP Sensor
150
50
6. Look up injector duration from VE table using load and engine speed
VE table
Air mass to injector duration table
70
7. Apply air temperature compensation
160
IAT compensation table
60
8. Further processing
180

ENGINE CONTROL UNIT USING SPEED DENSITY CONVERSION

BACKGROUND

The operation of a fuel injection system is well known in the art. Air enters the engine through the air induction system where it is measured by an air flow meter. As the air flows into the cylinder, fuel is mixed into the air by the fuel injector. Fuel injectors are arranged in the intake manifold behind each intake valve. The injectors are typically electrical solenoids that are operated by the engine control unit, or "ECU." The ECU pulse the injectors by switching the injector ground circuit on and off to release fuel into the cylinders.

When the injector is turned on, the valve opens to spray atomized fuel at the back side of the intake valve. As fuel is sprayed into the intake airstream, it mixes with the incoming air and vaporizes. The ECU preferably causes the injector to deliver fuel to achieve an ideal air/fuel ratio for the given engine, e.g. 14.7:1 for many engines, often referred to as the stoichiometry. The precise amount of fuel delivered to the engine is a governed by ECU control. That is, the ECU determines the basic injection quantity based upon the measured intake air volume and engine speed. Depending on other engine operating conditions, injection quantity will vary. The ECU can monitor variables such as coolant temperature, engine speed, throttle angle, and exhaust oxygen content to make injection corrections that determine final injection quantity.

In order to achieve the precise balance of fuel and air, the most important characteristic in the determination is the cylinder air mass. There are a number of methods to calculate cylinder air volume in order to correctly meter injected fuel. The most common method is to measure air mass flow using an air flow meter (AFM), also known as a mass air flow (MAF) sensor, which measures the air flow into the engine. With the air flow (in mass units per time) and the engine speed, the air mass in each cylinder can be calculated by dividing the air mass flow over the engine speed, number of cylinders, and number of engine rotations per induction strokes.

Once the cylinder air mass is known, calculating the fuel injector open time to achieve a desired air-fuel ratio requires calculating the mass of fuel required (from the cylinder air mass and desired air-fuel ratio) and then looking up a reference table for the fuel injectors to determine the injector opening time to deliver the fuel mass. A common expression for the actual air-fuel ratio over the stoichiometric optimal ratio is referred to as "lambda." The preceding two steps may be combined into one lookup table (from cylinder air mass to injector duration), or may be separated into tables indexed by fuel pressure, fuel temperature, battery voltage and other variables.

Air flow meters use a variety of methods to measure air flow, including hot wire and Karmen Vortex. These AFMs require a turbulence free air flow past the sensor in order to correctly meter the air flow. However, engine induction air flow consists of pulsations from each cylinder induction event. After-market engine modifications typically including larger duration camshafts, forced induction, high flow exhaust headers, etc., that can increase the pulsation effect in the intake system of the engine to such an extent that the AFM can no longer correctly meter the incoming air (see FIG. 1). Additional problems arise if the engine intake system is altered, which can cause the air flow past the AFM to be different from that which the ECU was calibrated for (see FIG. 2). This leads to greater scatter in the data and reduced performance.

SUMMARY OF THE INVENTION

The present invention utilizes a speed density method for determining the cylinder air mass using volumetric efficiency (VE) based on engine speed and manifold pressure. The VE data contain the cylinder filling efficiency for various engine speed and manifold pressure values. The manifold pressure is then measured by a manifold absolution pressure (MAP) sensor. Using the speed density has the advantage that it is much less affected by pulsation in the intake system of the vehicle, and does not require a linear air flow past a sensor in the engine intake system. For these reasons it is yields superior results to the prior injection systems that rely on AFMs for engine performance tuning (see FIG. 3)

BRIEF DESCRIPTION OF THE DRAWINGS

FIG. 4 is a flow chart of the method for using the volumetric efficiency;

DETAILED DESCRIPTION OF THE PREFERRED EMBODIMENTS

The present invention can be used to modify an existing ECU from a mass flow to a speed density system. Speed density is less effected by pulsations in the air flow, which lead to more accurate fuel injection determination and better performance. In order to change the operation of the ECU from mass flow to speed density, the ECU logic must be altered. First, volumetric efficiency tables with manifold pressure and engine speed indexes are added to the ECU program data. Intake air temperature compensation tables are also added to the ECU program data. During the operation of the ECU, the existing cylinder air mass to injector duration ECU code execution process is interrupted so that a new alternate program code routine is called rather than the cylinder air mass to injector duration subroutine. In one preferred embodiment, the alternate routine determines if the mass flow or speed density lookup should be performed. If using the customary mass flow, the program execution resumes with the normal cylinder air mass to injector duration subroutine. However, if the routine determines that the speed density is called for, a new subroutine is called that performs the VE table lookup and air temperature compensation, then resumes program execution at the point where the mass flow injector duration subroutine would normally return.

Figure 1:
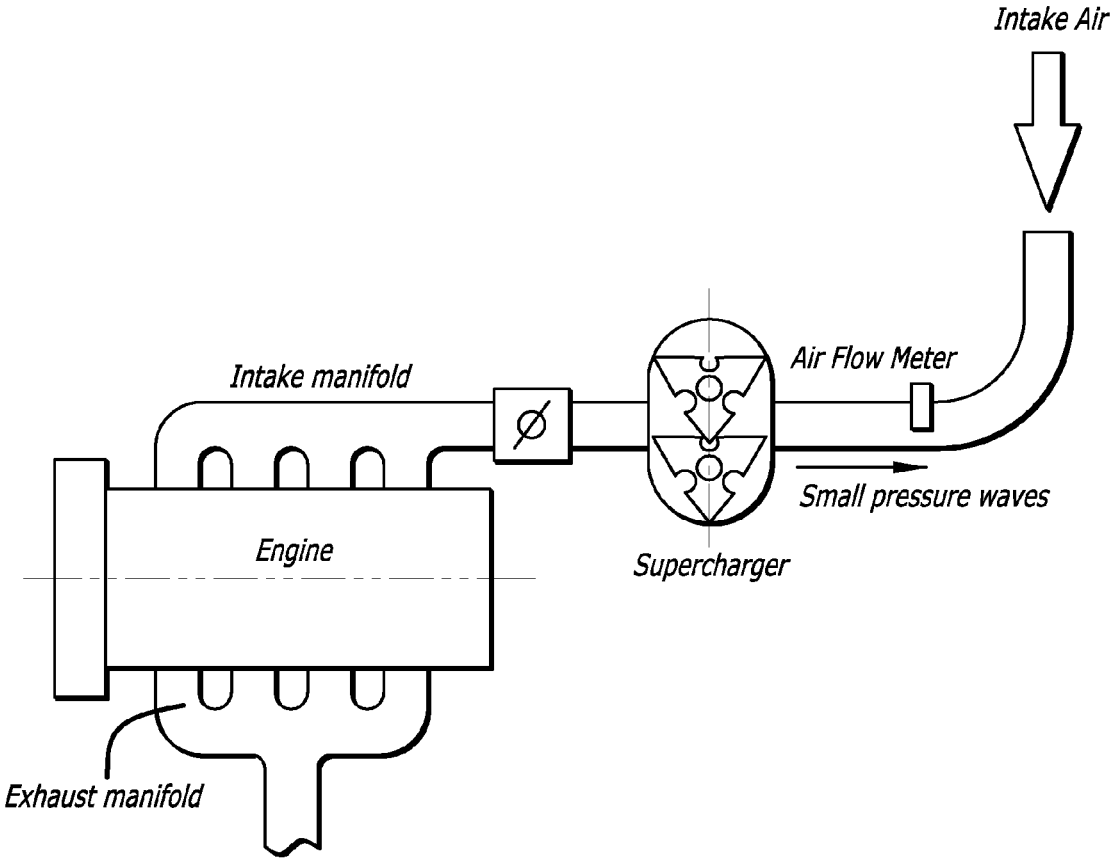
FIG. 1 (Prior Art)
FIG. 1 is a typical fuel injection system including pressure waves from a supercharger.
Figure 2:
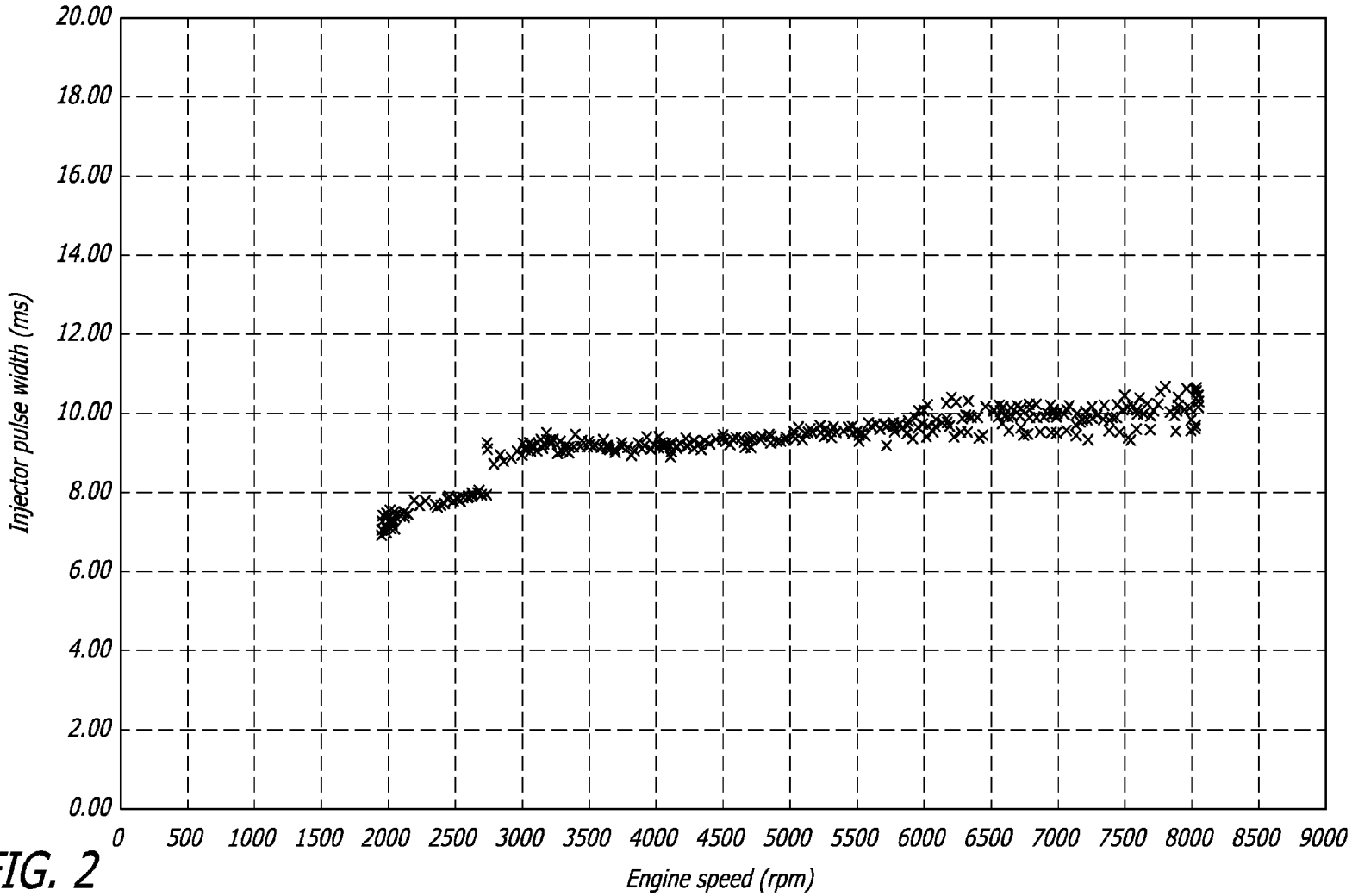
FIG. 2 is graph of fuel injector pulse width versus engine speed using an air flow meter.
Figure 3:
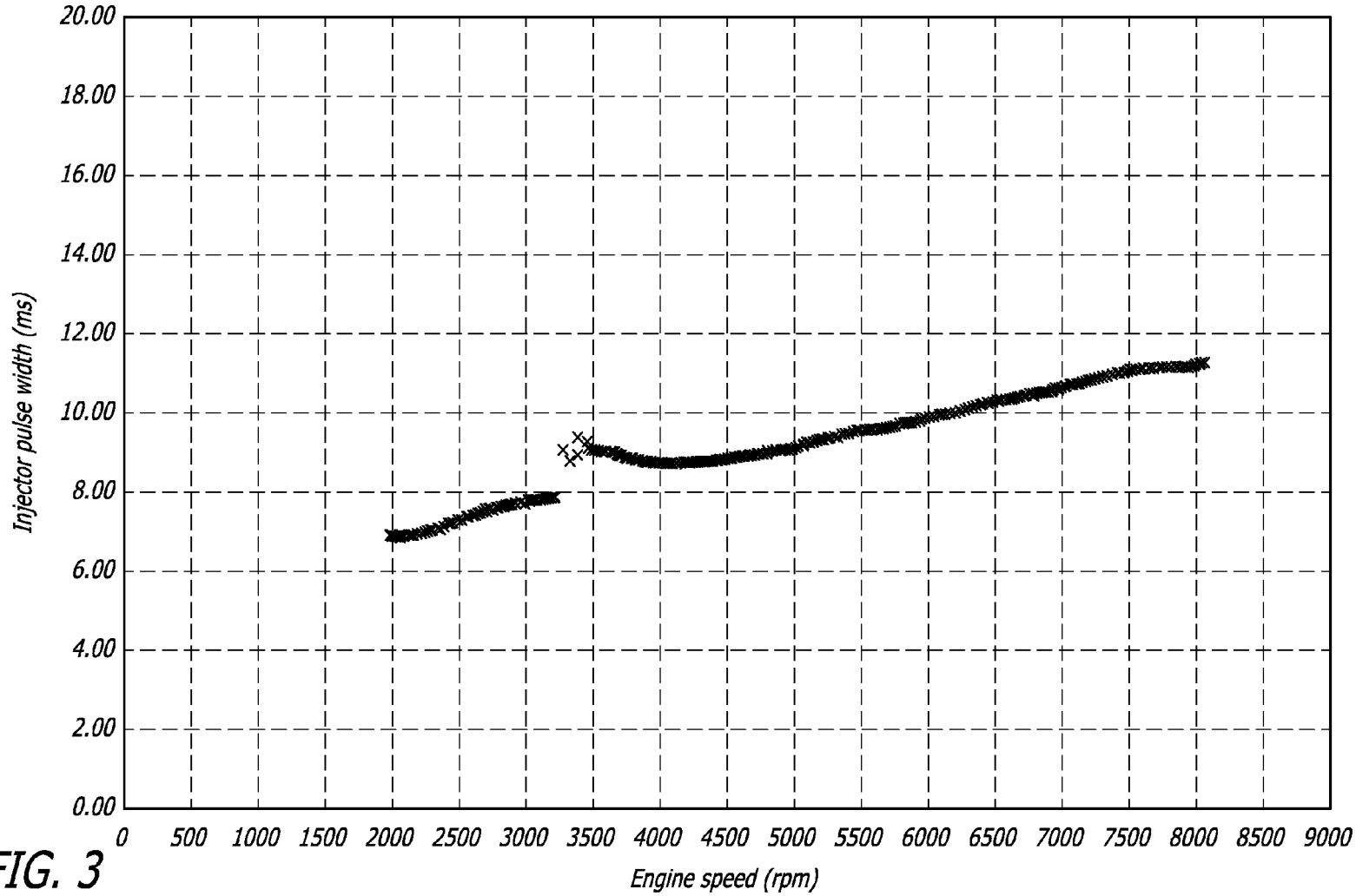
FIG. 3 is a graph of fuel injector pulse width versus engine speed using the present invention.
Figure 5:
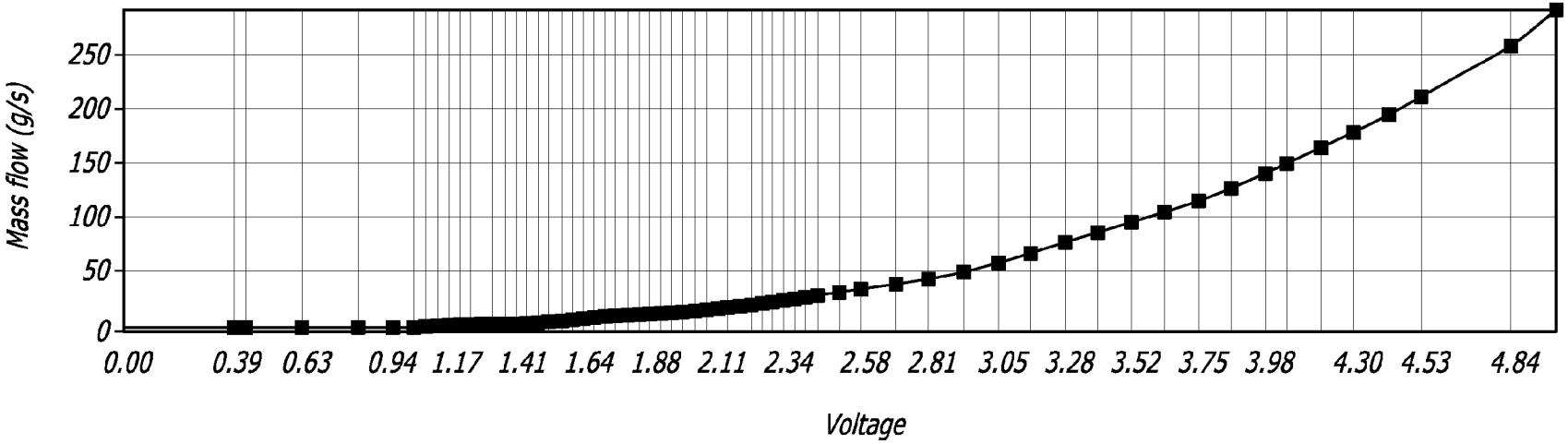
FIG. 5 is a graph showing the mass flow for a given voltage using the AFM.

An overview of the system will now be examined. FIG. 4 illustrates the operation of the ECU. The first step 100 in the process is the measurement of air flow. The voltage of the AFM sensor 20 is used as a scalar index to a lookup table containing the air flow in using of mass flow per time, e.g. air mass in grams flow per second (see FIG. 5). Once the lookup table has returned a value for the air flow, the next step 110 is to calculate the cylinder air mass. The air mass in each cylinder is calculated from the air mass flow divided by the number of engine induction events per unit time. The number of engine induction events per unit time is the speed of the engine 30 divided by the number of engine cycles per induction event. For example, for a. given a mass flow of 100 g/s and engine speed of 6000 rpm, for a four cycle engine the cylinder air mass is 500 mg.

Figure 6:
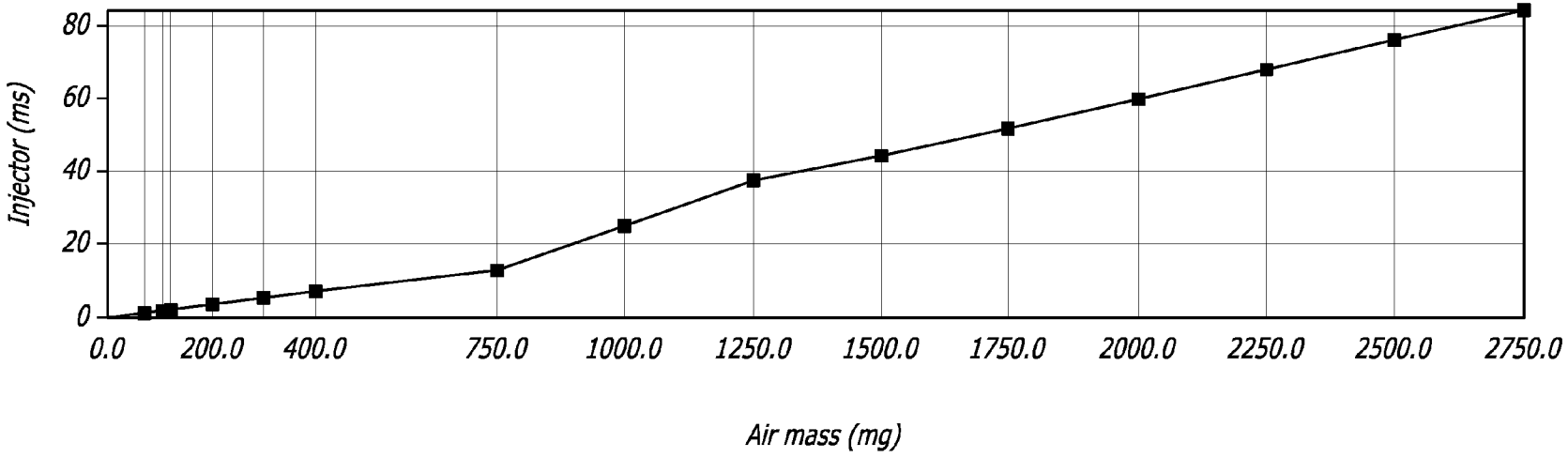
FIG. 6 is a graph of the duration of the injector opening for a given air mass.

Once the air flow and cylinder air mass are determined, the next step 120 is to determine if the speed density is to be used. This switch can be based on a predefined condition or on selected engine parameters such as load, engine speed, temperatures, and the like. The next step 130 is the injector duration (mass flow), which can be obtained from a lookup table 70 (FIG. 6). The cylinder air mass from step 110 is used as an index to the lookup table in FIG. 6 containing the injector duration necessary to achieve stoichiometric air to fuel mass in the cylinder. This is followed by the step 140 of measuring the manifold pressure. The voltage of the manifold absolute pressure, or "MAP" sensor 40 is used to determine the manifold pressure. A lookup table can be used, or if the MAP sensor pressure to voltage relationship is linear, scalar and offset calculations can be used to determine the MAP.

Figure 7:
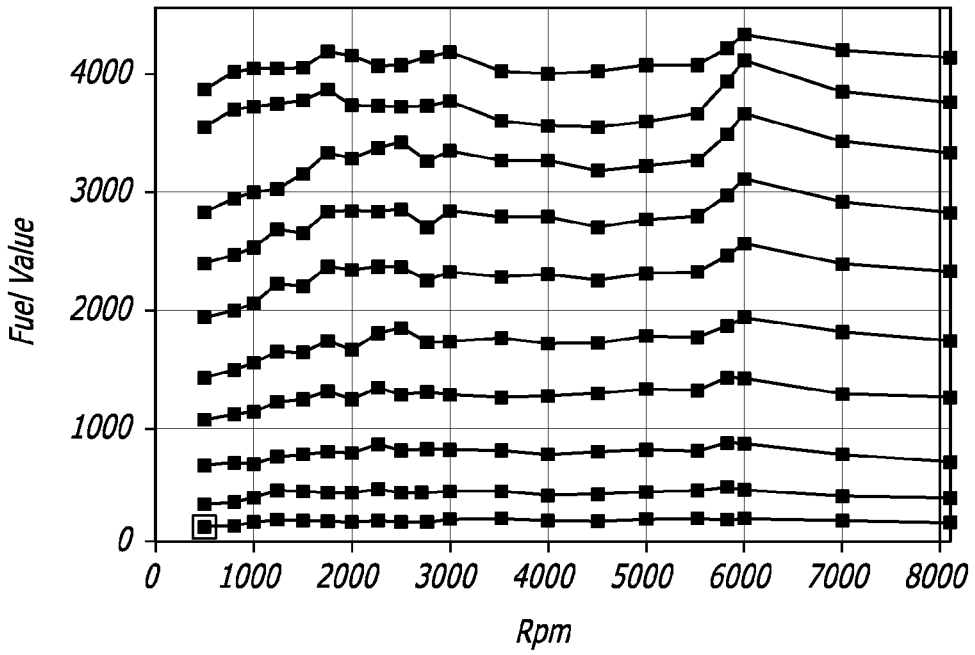
FIG. 7 is a graph of the fuel value for given load and engine speeds.
Figure 8:
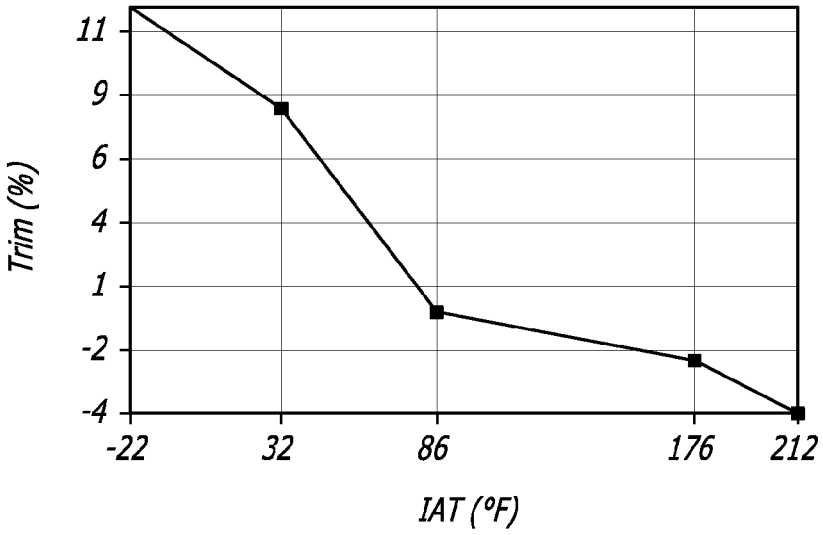
FIG. 8 is a graph of the temperature correction for the fuel determination.

The next step 150 in the process is the injector duration. MAP and engine speed are used as indexes to lookup table 50 (FIG. 7) containing VE (volumetric efficiency) values for each load and speed value. In the last step 160, the air temperature compensation is applied (speed density) using the IAT as an index to lookup an air temperature compensation table 60 (FIG. 8). Typically further corrections 180 such as closed loop, cold enrichment, acceleration enrichment, etc. are then applied to complete the process.

If the program code cannot be altered without requiring the program source code to be re-compiled, the program code must be patched to add the new functionality in such a way that its operation is not affected.

Existing Program Code

```
off_cyl_air:        .long cylinder_air_mass
off_mass_table:     .long air_mass_table
off_lookup:         .long lookup_table_sub
    mov.1           off_lookup, r10 ; lookup_table_sub
    ...
    mov.1           off_cyl_air, r6 ; cylinder air mass
    mov.1           off_mass_table, r4 ; air_mass_table
    jsr             @r10 ; call lookup_table_subroutine
    ...
    jsr             @r10 ; call lookup_table_subroutine
```

Modified Program Code

```
off_cyl_air:        .long cylinder_air_mass
off_mass_table:     .long air_mass_table
off_lookup:         .long speed_density_sub
    mov.1           off_lookup, r10 ; speed_density_sub
    ...
    mov.1           off_cyl_air, r6 ; cylinder air mass
    mov.1           off_mass_table, r4 ; air_mass_table
    jsr             @r10 ; calls speed density subroutine
    ...
    jsr             @r10 ; call lookup_table_subroutine
    ...
off_sd_lookup:      .long lookup_speed_density_sub
off_lookup:         .long lookup_table_sub
```

-continued

```
speed_density_sub:
    sts.1   pr, @-r15 ; save registers
    ; decide if we wish to use speed, density
    ...
    bt              use_mass_flow
    mov.1           off_sd_lookup, r2 ; call our speed density lookup
                    routine
    jsr             @r2
    bra             function_exit
use_mass_flow:
    ; call the original mass flow lookup subroutine
    mov.1           off_lookup, r10 ; lookup_table_sub
    jsr             @r10 ; lookup_table_sub
function_exit:
    ; restore r10 so the subsequent subroutine calls are ok
    mov.1           off_lookup, r10 ; lookup_table_sub
    lds.1           @r15+, pr ; restore registers
    rts
lookup_speed_density_sub:
    ; Our speed density lookup subroutine
    ; The output must be returned, in the same register as the mass
    ; flow subroutine
    ; The result should the compensated for IAT
    ...
    rts
```

The altered routine changes the mass flow to injector duration original subroutine call so that it calls the replacement subroutine 'speed_density_sub'. This subroutine then determines if speed density should be used to calculate the injector duration (step 120 above). If so, the speed density subroutine is called (steps 140, 150, and 160 above). After the speed density subroutine is executed, the register which holds the address of the mass flow subroutine is restored (lookup_table_sub above), otherwise subsequent calls using the register subroutine address will fail. If the speed density subroutine is not called, the original mass flow lookup subroutine is called, the register is restored, and the subroutine returns.

GLOSSARY

AFM=air flow meter. Also known as a MAF sensor.

IAT=intake air temperature.

ECU=engine control unit.

Lambda=the air/fuel ratio as a fraction of the stoichiometric ratio.

MAP=manifold absolute pressure. The air pressure in the intake manifold referenced to vacuum.

MAF=mass air flow.

Mass flow=one method of calculating engine fuel requirements be measuring the air mass entering the engine.

Speed density=one method of calculating engine fuel requirements by measuring manifold pressure (MAP) and engine speed, then referring to a VE (volumetric efficiency) lookup table.

I claim:

1. A method for injecting fuel into an engine comprising:

providing an engine control unit;

modifying the engine control unit to evaluate fuel injection duration using two methods in situ;

providing an air flow meter;

measuring air flow using the air flow meter;

calculating cylinder air mass using the engine speed;

providing a manifold air pressure (MAP) sensor;

measuring a manifold pressure using the MAP sensor;

storing in the memory of the engine control unit volumetric efficiency values for each load and speed value;

determining a fuel injection duration by the engine control unit using the measured mass flow and determining a new fuel injection duration determined by the engine control unit using the volumetric efficiency at the given load and speed value;

selecting a fuel injector duration using the given load and speed value using volumetric efficiency if determines it the engine control unit determines that it is preferable to the fuel injection duration using the air flow measurement;

applying an air temperature compensation;

injecting fuel into a combustion chamber for the selected fuel injection duration; and returning the injector duration control using the mass flow meter measurement.

2. The method of claim 1 further comprising an air mass versus injection duration table for determining injection duration using the mass flow sensor.

3. The method of claim 1 further comprising means for adjusting the instructions based on one of the group comprising closed loop, cold enrichment, and acceleration enrichment.

* * * * *